US005454330A

United States Patent [19]

Rhen

[11] Patent Number: 5,454,330

[45] Date of Patent: Oct. 3, 1995

[54] RAILWAY TRUCK SIDE BEARING

[75] Inventor: Dennis Rhen, McMurray, Pa.

[73] Assignee: Hansen, Inc., Pittsburgh, Pa.

[21] Appl. No.: 312,031

[22] Filed: Sep. 26, 1994

Related U.S. Application Data

[62] Division of Ser. No. 57,441, May 4, 1993, Pat. No. 5,386, 783, which is a continuation of Ser. No. 630,336, Dec. 17, 1990, abandoned, which is a continuation of Ser. No. 473,307, Feb. 1, 1990, abandoned.

[51] Int. Cl.[6] ..... B61F 5/14

[52] U.S. Cl. ..... 105/199.3

[58] Field of Search ..... 105/199.3; 384/423, 384/595, 597, 620

[56] References Cited

U.S. PATENT DOCUMENTS

| | | | |
|---|---|---|---|
| 38,182 | 4/1863 | Sherman | 105/199.3 X |
| 675,727 | 6/1901 | Goltra | 384/423 |
| 1,831,926 | 11/1931 | O'Connor | 384/602 |
| 2,301,372 | 11/1942 | Cottrell | 384/422 |
| 2,754,768 | 7/1956 | Hile | 105/193 X |
| 3,255,712 | 6/1966 | Barber | 105/199.3 |
| 3,295,463 | 1/1967 | Barber | 105/199.3 |
| 3,313,245 | 4/1967 | Sundby | 105/198.7 |
| 3,493,221 | 2/1970 | Mozdzankowski | 267/153 |
| 3,518,948 | 7/1970 | King et al. | 105/197.05 |
| 3,556,503 | 1/1971 | Van Moss, Jr. | 267/3 |
| 3,628,464 | 12/1971 | Van Moss, Jr. | 105/199.3 |
| 3,670,661 | 6/1972 | Pangalila | 105/199.3 |
| 3,719,154 | 3/1973 | Reynolds | 105/199.3 |
| 3,796,167 | 3/1974 | Van Moss, Jr. | 105/199.3 |
| 3,957,318 | 5/1976 | Wiebe | 384/423 |
| 4,088,016 | 3/1978 | Wiebe | 384/423 |
| 4,090,750 | 5/1978 | Wiebe | 105/199.3 X |
| 4,859,089 | 8/1989 | Wright | 384/423 |
| 5,207,161 | 5/1993 | Pileggi et al. | 105/199.3 X |

*Primary Examiner*—Robert J. Oberleitner
*Assistant Examiner*—S. Joseph Morano
*Attorney, Agent, or Firm*—J. Stewart Brams

[57] ABSTRACT

A side bearing for a railway truck and car body assembly including one or a plurality of elastomeric bearing elements, confined at given locations in a side bearing carrier and vertically extended rigid abutments disposed adjacent the elastomeric element(s), and a roller or similar rigid bearing element disposed to be free rolling within defined limits with respect to the elastomeric elements.

3 Claims, 8 Drawing Sheets

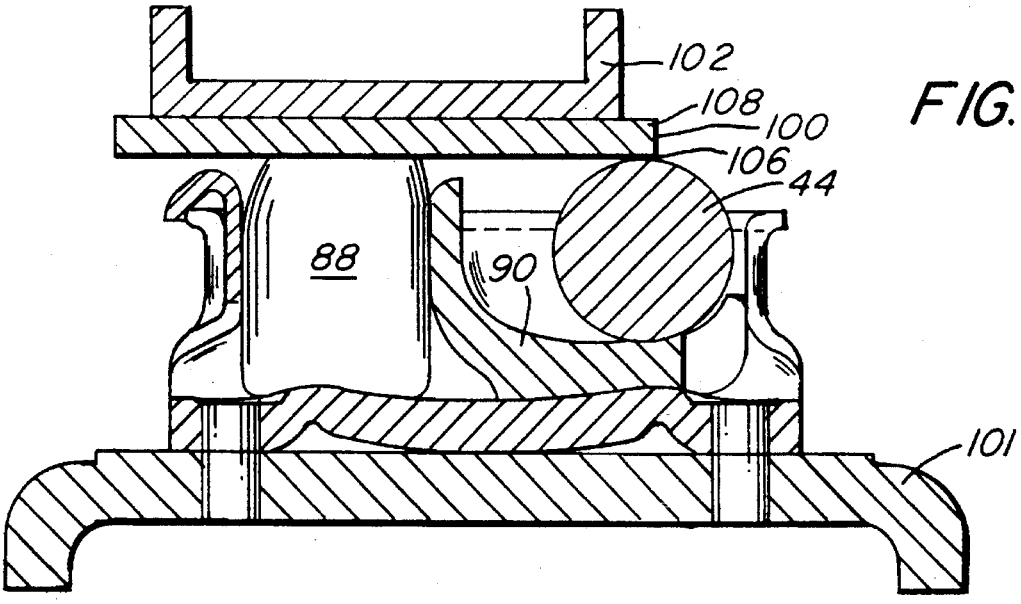
FIG. 6
FIG. 7
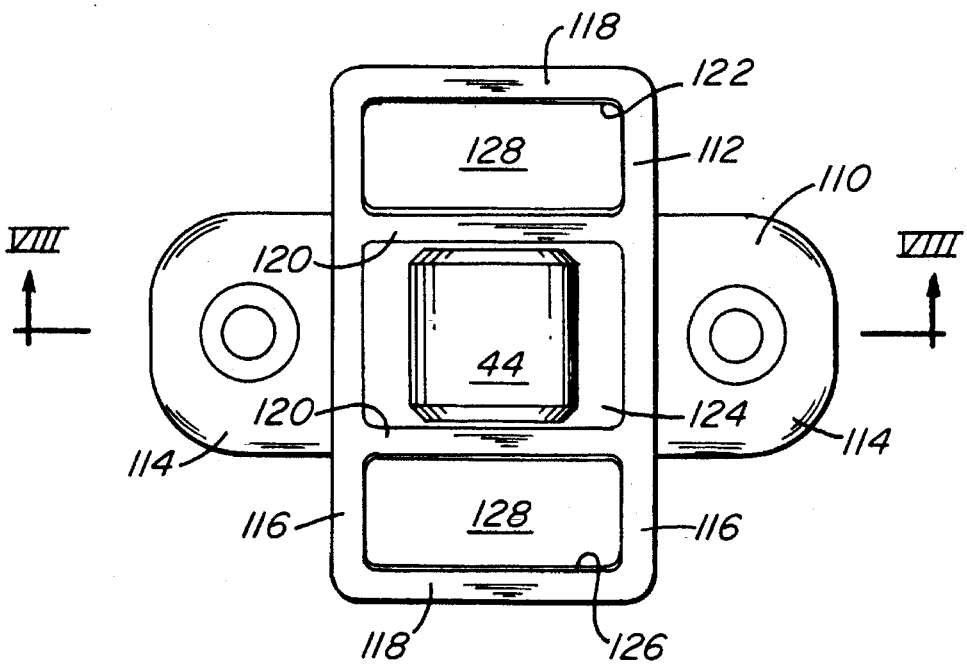

RAILWAY TRUCK SIDE BEARING

BACKGROUND OF THE INVENTION

This is a divisional application of application Ser. No. 08/057,441, filed May 4, 1993 now U.S. Pat. No. 5,386,783, which is a continuation of application Ser. No. 07/630,336, now abandoned, which is a continuation of application Ser. No. 07/473,307, now abandoned.

A railway freight car commonly includes a car body supported on the center plates of a pair of longitudinally spaced trucks. The coned wheels of the trucks engage the respective rails of a railway track and the trucks travel a generally sinuous path along tangent track as they continually seek a centered position under the steering influence of the wheel conicity. In traveling such a sinuous path, a railway truck will oscillate laterally and yaw cyclically with respect to the car body about the vertical axis defined by the vertical center line of the truck bolster center plate. A railway truck also will yaw or rotate quasi-statically with respect to the car body in negotiating curved track.

As a result of such lateral truck oscillation and cyclic yawing, unstable truck hunting responses can develop if the frequency of the cyclic motion approaches resonance. Reference is made hereby to prior U.S. Pat. No. 3,957,318 for further detailed explanation of railway vehicle truck hunting phenomena, and such explanation is hereby incorporated herein by reference.

Railway car body rock and roll is another problem in railway car stability that is related to the truck hunting phenomenon. As the trucks of a railway car negotiate their sinuous path of travel along the railway track, the car body will move laterally in concert with the cyclic lateral movement of the truck center plates. The loaded or heavy car readily tolerates this lateral oscillation; however, the empty or light car body may be driven to rock laterally from side to side. As with known truck hunting phenomena, this lateral rock and roll empty car body motion can also be driven by resonant coupling to destructive extremes.

Railway truck side bearings have long been utilized to provide support for a car body with respect to a truck laterally outward of the truck center plate. Such support is necessary not only in view of the tendency of an empty car body to rock from side to side as a result of the force inputs of hunting or rock and roll phenomena, but additionally by the negotiation of track curves and the superelevated track encountered in curves.

Older Conventional side bearings have included roller bearings carried for rolling movement longitudinally within an elongated cage or carrier mounted on a railway truck bolster. The roller extends above the uppermost extent of the open top of the carrier for rolling engagement with a wear plate carried by the car body. Such side bearings are able to support a car body with respect to a truck bolster laterally outward of the truck center plate while at the same time permitting the bolster, and therefore the truck, the freedom to rotate with respect to the car body as is necessary to accommodate the normal truck movement along both tangent and curved track as above described.

The art has also contemplated railway truck side bearings which serve not only to support a car body with respect to a truck bolster during relative rotational movement therebetween, but in addition to dissipate energy through frictional engagement between the car body wear plate and a bearing element whereby the requisite rotational freedom of the truck with respect to the car body is maintained while a degree of restraint is also provided as a means to control and limit destructive hunting responses. Still further, the prior art has contemplated the use of elastomeric elements to cushion the vertical loading of a car body on a truck bolster exerted through the side bearing structure. Still other prior side bearings have contemplated roller bearing structures with self-centering rollers.

Among the prior side bearings known in the art as above characterized are those disclosed in U.S. Pat. Nos. 1,831,926, 2,301,372, 2,754,768, 3,255,712, 3,295,463, 3,313,245, 3,493,221, 3,518,948, 3,556,503, 3,628,464, 3,670,661, 3,719,154, 3,796,167 and 4,859,089.

In some prior side bearings, the desired function was purely to minimize friction, as in roller side bearings. In others, friction elements were intentionally introduced to provide both support and rotational freedom for the car body with respect to the truck bolster, as well as rotational restraint through the frictional dissipation of energy. The above-cited patent 4,859,089 is one example of such an energy dissipating side bearing.

Other more recent prior art side bearings such as that disclosed in U.S. Pat. No. 4,090,750 have contemplated the use of bearing elements formed of elastomeric columns and upstanding rigid abutments which are engageable with a car body wear plate to provide both vertical support and relative rotational freedom for the car body with respect to the bolster, as well as a friction interface between the elastomeric columns and the car body wear plate to provide frictional energy dissipation upon relative rotation of the car body with respect to the bolster.

Still other recent prior art side bearings such as those disclosed in U.S. Pat. Nos. 4,080,016 and 3,957,318, combine elastomeric columns to provide support and frictional energy dissipation as above characterized, and roller elements to limit the magnitude of vertical deflection of the elastomeric elements by providing a solid stop beyond which the car body wear plate cannot move vertically downward. The roller elements provide, at the limit of vertical motion of the wear plate downward toward the bolster, a range of relative rotational freedom for the car body with respect to the bolster without significantly increasing frictional restraint with greater side bearing loading beyond that afforded by the elastomeric columns alone.

Another truck bearing structure, not so recent, is disclosed in U.S. Pat. No. 38,182 as a ball bearing element disposed in a downwardly concave cup which is in turn resiliently supported by an elastomeric ring element.

The present invention contemplates a novel and improved railway truck side bearing structure especially well suited for use in railway truck and car body combinations unknown when many of the above cited prior bearings were developed. Others of the above prior side bearings, although developed when the more modern truck and car body combinations were known and could be suitably adapted for use thereon, were nevertheless not specifically developed for use with such truck and car body assemblies and their design and development did not contemplate the operating conditions and problems posed by modern car configurations.

More specifically, certain newer types of railway cars utilize articulated couplings between pairs of adjacent car platforms that share a common intermediate truck having a flat center plate bearing. These and other car configurations often may have longer spacing between adjacent trucks; that is, the car platform lengths, and therefore the inter-truck spacing may be greater than in conventional cars. Stacking of containerized loads and similar transport modes for these and other cars, often characterized as intermodal cars, has resulted in loaded cars with extremely high centers of gravity, for example as much as 110 inches above the track.

In these and other car configurations, the role of the side bearing in supporting the car body with respect to the bolster has been altered dramatically. For example, in very high center of gravity loaded cars, most particularly the double stacked container configurations, the loaded car body center of gravity is located well above the articulated connector by which at least one end of the car body is supported. Even if the opposed end of the car body is supported by its own truck on a conventional flat center plate bearing, and even if the lading is centered on the car platform, the torsional stiffness of the car platform and containerized lading may be insufficient to keep the car body end that is supported in spherical bearing segments from leaning continuously to one lateral side or the other for relatively extended periods of car travel. If the lading is off-center, or in such operational circumstances as the traverse of track curves, extended periods of large magnitude side bearing loading may be virtually unavoidable. Accordingly, the corresponding side bearing may be required to support a much greater than normal load through extended periods of car travel. Thus, the side bearing must accommodate controlled rotational freedom between the truck and the car body through an angle equivalent to the maximum relative rotation therebetween, and this in turn requires maximum longitudinal rolling freedom for the roller bearing element. The maximum relative rotation between a car body and a truck in normal operation may be as great as the relative rotation experienced from a short radius left hand turnout to a similarly short radiused right hand turnout, although more typically the range of relative truck-to-car body rotation which the side bearing must accommodate would be that experienced in the spiral or entry portion of a track curve.

The extended platform lengths of some modern cars also can require a greater range of relative rotational freedom between the truck and the car platform because a longer platform requires a greater angle of relative rotation between the platform and the respective trucks to negotiate curved track of any given radius. Still further, with greater car load capacities and higher centers of gravity there is impetus for designers to place the side bearings at a greater radius from the truck center plate or articulated connector to maximize the lateral moment arm of the side bearing with respect to the center plate bearing. This too increases the magnitude of roller bearing movement needed to accommodate relative truck-to-car body rotation. An additional design problem is that the geometric limitations of truck and car body design limit the physical size of the side bearing components that can be utilized in a given application. It is preferred under most circumstances to keep the "footprint" of a side bearing (i.e. the size of the car body wear plate required to cooperate with the side bearing) as small as possible, even though modern car designs often call for increased rather than reduced bearing load capacity and range of movement.

BRIEF SUMMARY OF THE INVENTION

The present invention contemplates an improved side bearing structure which is especially well suited for use with intermodal cars and similar modern car configurations having large load capacities, high centers of gravity, longer truck spacing, and other design features to which some prior side bearings might be less well suited in the task of optimizing the dynamic performance of the car. The invention contemplates generally a railway truck side bearing assembly which is preferably adapted to be confined within a generally conventional, standard railway truck side bearing housing or carrier and including at least one upstanding elastomeric bearing element and a longitudinally adjacent spacer member disposed within the carrier. The spacer member includes at least one upstanding abutment which longitudinally confines a corresponding elastomeric column, and a generally upwardly facing elongated surface to receive a rigid bearing element such as a roller therein. The roller is provided a range of free rolling movement longitudinally of the spacer member between stops or limits defined by longitudinally spaced portions of the spacer member.

The range of free movement for the roller can be made sufficient to accommodate the greater range of relative rotary movement between a bolster and a car platform required in modern car configurations as discussed hereinabove without sacrifice of frictional energy dissipation capability provided by the elastomeric columns. This is so in part because the upstanding abutments of the spacer member can extend upwardly above the uppermost extent of the bearing carrier or housing and adjacent an upper portion of a corresponding elastomeric column to longitudinally buttress and confine the elastomeric element sufficiently that it does not bend longitudinally over the top of the confining abutment.

Accordingly, surface contact between the upwardly facing bearing surface of the elastomeric column and the car body wear plate is maintained more uniformly and the full benefit of the shear restraint and frictional energy dissipation at the elastomer-to-rigid wear plate interface thus is realized. As a result, a smaller section thickness of elastomer, especially in the longitudinal direction, may be employed to attain the same levels of performance as regards shear restraint as in prior elastomeric side bearings requiring larger section elastomeric columns. Thus, without sacrificing the desirable control capabilities of a larger section elastomeric column, an increased range of longitudinal roller motion is made available in a side bearing housing of given dimensions.

It is therefore one object of the present invention to provide a novel and improved railway truck side bearing;

Another object of the invention is to provide an improved railway truck side bearing comprised of at least one upstanding elastomeric column bearing and a rigid roller or similar element which provides a rigid limit to vertical compression of the elastomeric column, and structure and method of partially confining the elastomeric column and maximizing the free rolling range for the bearing roller element.

Still another object of the invention is to provide, for use in a railway truck side bearing, an abutment or spacer element which serves to partially confine an upper extent of an elastomeric bearing element and in addition to elevate the rolling surface of a rigid roller bearing element above the base of the bearing housing such that a smaller diameter roller than commonly employed may be utilized.

These and other objects and further advantages of the invention will be more fully appreciated upon consideration of the following detailed description and the accompanying drawings in which:

FIG. 6 is a sectioned side elevation similar to FIG. 5 and including representation of a car body wear plate to illustrate one operating condition for the illustrated side bearing;

FIG. 7 is a top plan view of another alternative embodiment of the invention;

Figure 1:
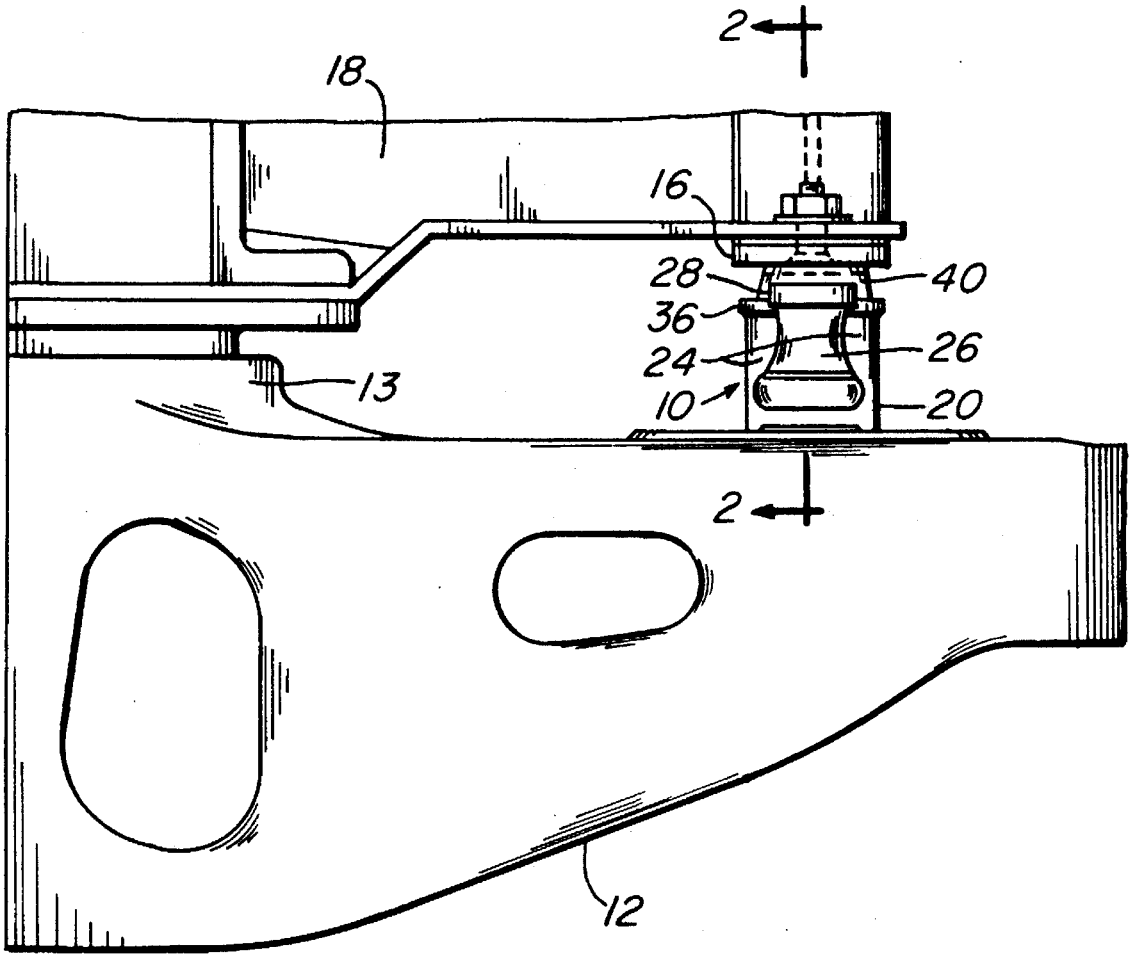
FIG. 1 is an end elevation showing a side bearing according to one presently preferred embodiment of the instant invention and cooperating portions of a railway truck and car body.
Figure 2:
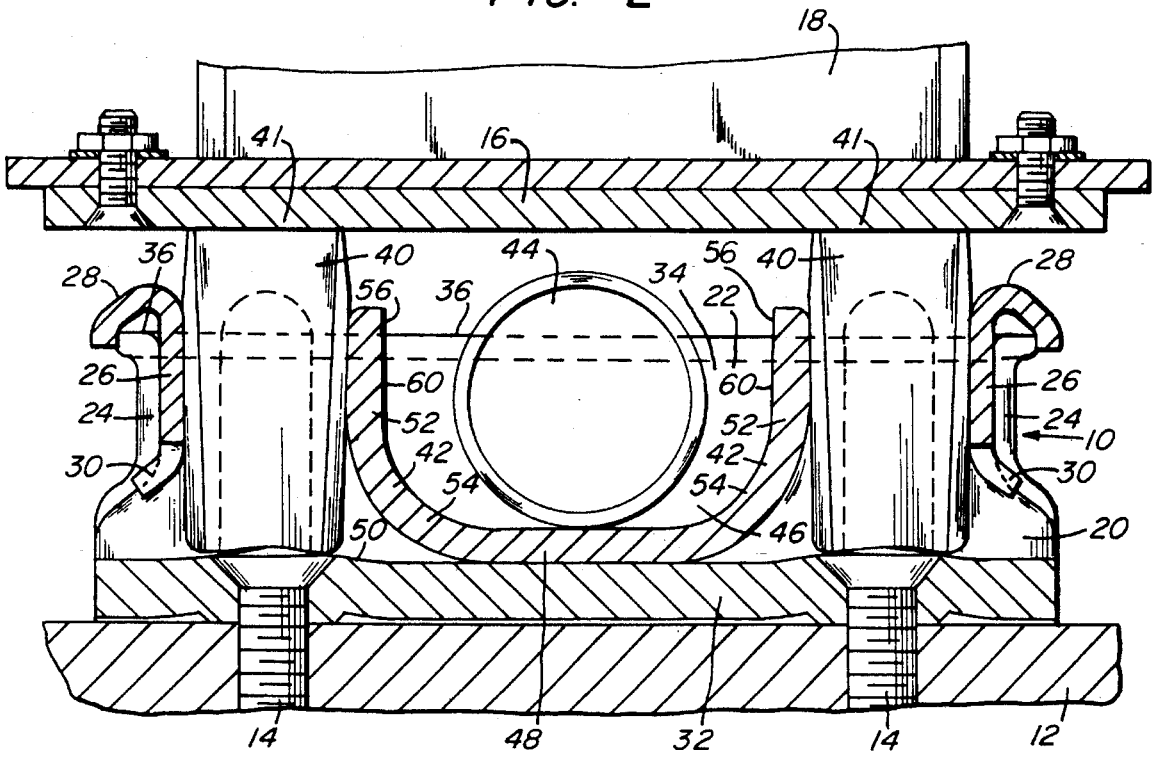
FIG. 2 is a sectioned side elevation of a side bearing taken on line 2—2 of FIG. 1.

There is generally indicated at 10 in FIGS. 1 and 2 a side bearing assembly which is carried atop a bolster 12 of a railway truck and is secured thereto as by threaded fasteners 14 for cooperative interaction with the wear plate 16 of a rail car body 18 supported by a center plate bearing portion 13 of bolster 12. Although this invention will be described with reference to a conventional truck bolster and center plate support system as in a known three piece truck, it will be understood that the invention may also be utilized in other car body support applications such as intermodal cars or other car configurations where adjacent car platforms are supported through the bearing segments, commonly spherical in form, of an articulated coupling that is supported on a truck, as well as alternative truck configurations such as single axle trucks. For application in a conventional three piece truck, other known components not shown include spring groups mounted in a pair of side frames to support the opposed longitudinal ends of bolster 12, and suitably journaled wheelsets which rest on tracks or rails to support each side frame of the truck.

The invention herein is directed primarily to side bearing assemblies such as shown at 10, and the balance of the truck and car body elements set forth hereinabove are well known in the art. Further detailed description of such elements thus is not necessary for understanding of the present invention.

The invention also contemplates in one presently preferred embodiment an assembly of side bearing components adapted to be received within a side bearing housing or carrier 20 of generally conventional design, or alternatively in a new and heretofore unknown side bearing carrier. The side bearing assembly 10 comprises the elongated bearing carrier or housing 20 having a pair of elongated, upstanding, laterally spaced side walls 22 and a pair of longitudinally spaced, upstanding end walls 24 which may be comprised of respective pairs of laterally adjacent, inturned end flange portions of side walls 22. For this and other bearing carrier end wall configurations, shim plates 26 may be assembled with end wall portions 24 such that upper portions 28 thereof overlie the uppermost extent of end wall portions 24, and a lower extent 30 of each shim plate 26 extends adjacent an inner surface of the end wall portions 24, respectively, and downwardly into the confines of carrier 20.

The carrier 20 further includes a longitudinally and laterally extending base portion 32 which, in conjunction with side walls 22 and end walls 24, forms an upwardly opening cavity 34 to receive and confine an assembly of side bearing elements.

It will be seen that side walls 22 and end walls 24 project upwardly to an uppermost extent which is at a uniform elevation. Additionally, the upper extent 28 of each shim plate 26 projects to an elevation above the uppermost extent 36 of the side and end walls 22, 24 for a purpose to be described hereinbelow.

Within the confines of space 34 is received an assembly of bearing elements comprised preferably of a pair of elongated, upstanding elastomeric columns 40, one received in each longitudinal end of space 34 adjacent a respective end wall portion 24 and in longitudinal abutment with the respective shim plate 26, an elongated spacer or abutment member 42 received within space 34 longitudinally intermediate elastomeric columns 40, and a rigid bearing member such as a roller 44 is received within space 34 intermediate side walls 22 and within the confinement of an upwardly opening concavity 46 formed by abutment member 42.

Spacer member 42, also referred to alternatively as a saddle, includes a longitudinally extending base portion 48 which rests upon an upper surface 50 of carrier base portion 32, a pair of upstanding end abutment portions 52 which are spaced longitudinally apart to reside longitudinally inwardly adjacent the respective elastomeric columns 40, and integral curved or radiused portions 54 which extend intermediate base portion 48 and the respective abutment portions 52.

It will be noted that abutment portions 52 extend upwardly to an uppermost extent 56 which, like the uppermost portions 28 of shim plates 26, project above the upper extent 36 of the side walls 22 and end walls 24 to an elevation preferably just slightly below the highest elevation of roller 44. Accordingly, upstanding abutments are provided at an elevation above the highest lateral abutment provided by carrier 20 such that the relative rotational movement between bolster 12 and car body 18 occurs at all load levels with reduced tendency for elastomeric columns 40 to bend longitudinally, and therefore reduced tendency for development of non-uniform loading of the elastomeric columns 40 in compression. More particularly, relative rotation between car body 18 and bolster 12 results at all load levels in shear deformation of elastomeric columns 40 in the longitudinal direction and ultimate friction break and longitudinal sliding of wear plate 16 on the uppermost surfaces 41 of elastomeric columns 40. Both the control provided by horizontal shear deformation of the elastomeric columns prior to frictional sliding between surfaces 41 and wear plate 16, and the energy dissipation achieved by frictional sliding movement between the surfaces 41 and plate 16 are optimized in part by abutments 52 which constrain the elastomeric columns 40 to remain essentially upright under all operating conditions and load levels.

In prior side bearings wherein a relatively elongated extent of an elastomeric column projected above the highest longitudinal abutments and was therefore relatively unconfined in at least one longitudinal direction, relative rotation of the bolster about a vertical axis with respect to the car body, with the car body wear plate engaging the side bearing elastomeric columns, produced in the longitudinally unconfined elastomeric columns a tendency to bend longitudinally. This is especially true of the trailing or rearward elastomeric column, reckoned with respect to the direction of longitudinal movement of the car body wear plate 16 with respect to the side bearing assembly. Such elastomer column bending produces non-uniform loading across the surface 41 of the elastomeric element thereby significantly degrading the shear restraint available at the wear plate-to-elastomer interface. By providing abutments projecting upwardly, preferably above the bearing carrier side and end walls, and especially for the longitudinally opposed sides of the elastomeric element, improved longitudinal confinement of the elastomeric element enhances the uniformity of loading on the uppermost surface thereof. As a result, the shear restraint available at the wear plate-to-elastomer interface is of both greater magnitude and improved uniformity over that available without such longitudinal abutments.

Accordingly, the desired characteristics of shear restraint in the elastomer-to-wear plate interface can be achieved with elastomeric columns of smaller cross section than required in prior side bearings. Therefore, within the confines of a given bearing carrier 20 more longitudinal space is available between elastomeric elements 40 by use of smaller section elastomeric elements to provide a greater longitudinal rolling range for roller 44. The side bearing thus can accommodate increased angular rotation between truck 12 and car body 18.

The inwardly facing surfaces 60 of member 48 provide rigid stops or limits for roller movement such that roller 44 will not laterally deform elastomeric elements 40 as it rolls longitudinally to one extreme or the other in its longitudinal travel. However, it will be noted that the spacer member 48 is free to move or rock longitudinally with respect to housing 20 so that when roller 44 engages one of surfaces 60, the member 48 can roll or tilt slightly in the same longitudinal direction by limited longitudinal compression of the adjacent elastomeric column 40. The member 48 thereby provides a further increment of roller movement in the longitudinal direction and cushions the engagement of the roller on the surface 60.

It will be noted that the uppermost extent of roller 44 projects above the uppermost extent of the side walls 22 and end walls 24, and additionally above the uppermost extent of the shim plate upper ends 28. The roller 44 also projects above the uppermost projection 56 of the abutment portions 52, although preferably only very slightly above. Accordingly, when the loading on elastomeric columns 40 deforms them in vertical compression to the solid condition whereat plate 16 engages roller 44, plate 16 remains at all times clear of contact with side walls 22, end walls 24, shim plates 26 and abutment projections 56, and only a very minimal vertical extent of the elastomeric columns projects above the uppermost extent 56 of abutments 52.

Inasmuch as one object of this invention is to provide, within the confines of a given bearing carrier, the necessary longitudinal free rolling range for a roller bearing element to accommodate the greater relative rotational movement between a truck and a car platform as must be accommodated in some modern cars, it will be noted that an additional advantage provided by abutment member 48 is that it elevates the rolling surface on which roller 44 is supported above the uppermost surface 50 of base 32. Accordingly, the uppermost extent of roller 44 projects further upward by an equal increment thereby permitting the use of a smaller diameter roller than could be otherwise employed, where the load limits to be encountered by the roller bearing permit. A smaller diameter roller occupies less of the longitudinal rolling range available between the limits defined by the abutment member 48 thereby providing further increased longitudinal free rolling range for the roller 44. Accordingly, the smaller diameter roller allows the accommodation of larger ranges of relative angular rotation between a truck and a car body within the confines of a given side bearing carrier or housing 20.

Figure 3:
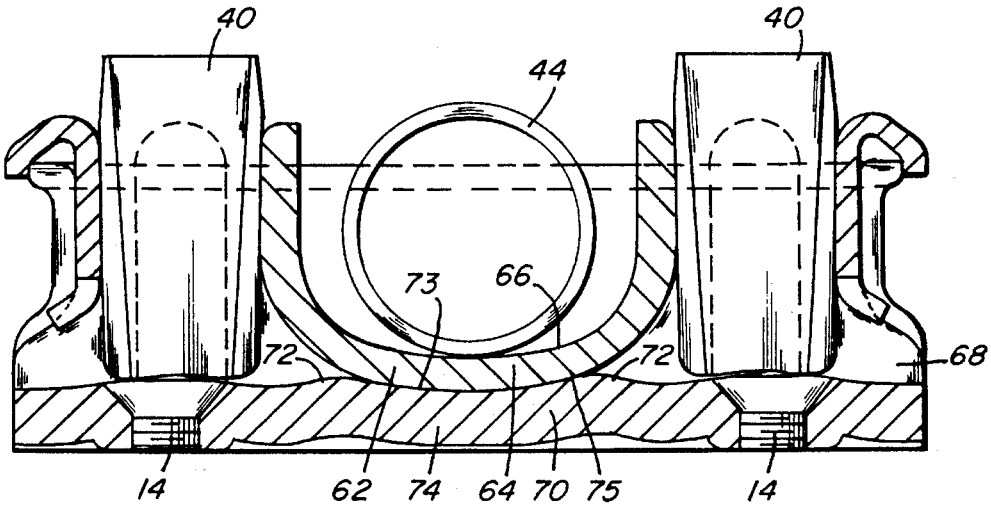
FIG. 3 is a sectioned side elevation showing an alternative embodiment of the instant invention.
Figure 4:
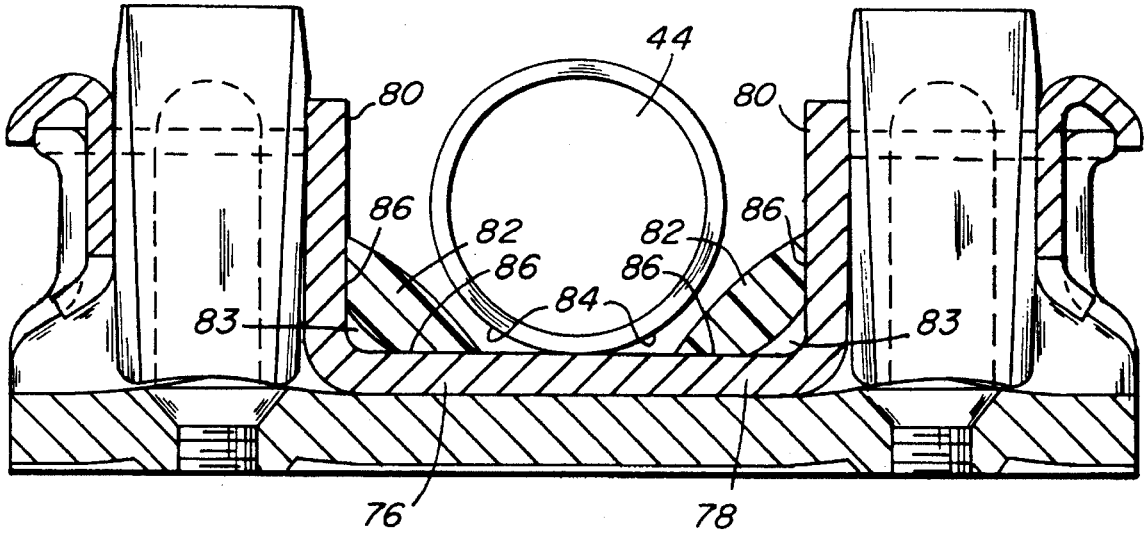
FIG. 4 is a sectioned side elevation showing another alternative embodiment of the instant invention.
Figure 5:
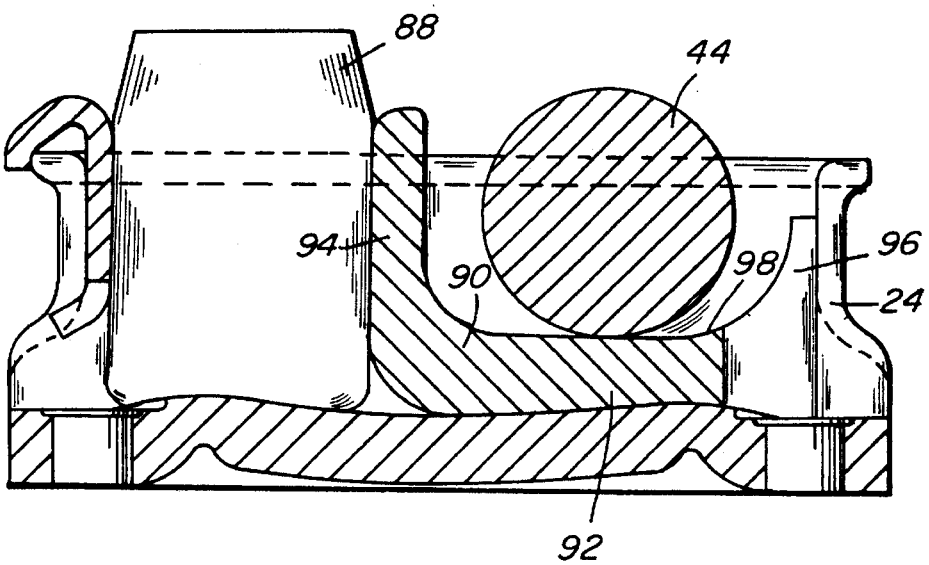
FIG. 5 is a sectioned side elevation showing still another alternative embodiment of the invention.

Other embodiments of the invention are shown in FIGS. 3 through 5. In FIG. 3 the bearing assembly shown is essentially identical in most salient respects to that described hereinabove with reference to FIGS. 1 and 2; however, the abutment member 62 is configured to include a base portion 64 which is of a concave configuration to provide a generally concave upper surface 66 on which roller 44 is supported. The roller 44 thus tends to be gravitationally self-centering when in a free rolling state (i.e. not engaged by the car body wear plate) to ensure that sufficient free rolling range in either longitudinal direction will be available upon contact of the roller 44 by the car body wear plate. It will be recalled that some modern cars with extremely high centers of gravity when loaded will tend to lean over on one or the other of side bearings on a given truck for relatively long periods of travel. For any embodiment of this invention, the longitudinal free rolling space for roller 44, when centered, should be sufficient to accommodate the relative truck to car body rotation required to traverse ordinary main line and secondary track curvatures.

Additionally, abutment member 62 is free to rock longitudinally within housing 68 if the concave upper surface 73 on which member 62 rests is of a larger radius than the mating convex surface 75 of member 62. As member 62 rocks, the upstanding abutment at the leading end thereof (with respect to the direction of its longitudinal rocking) compresses the corresponding elastomeric element 40. The rocking action of member 62 presents to the roller a progressively lower angle of inclination on surface 66 as the roller 44 moves up the incline of surface 66 when displaced from its centered position. Without the rocking capability for member 62, as the roller moves to one side or the other from its centered position it rolls up the centering incline, and the side bearing thus is lifting the entire weight supported thereon vertically upward. This increase in the vertical loading on the side bearing roller, increases the directly proportional horizontal restraint between the roller and body plate 16, which is undesirable; however, such lifting reduces elastomer compression incrementally and thus tends to offset the increase in roller-to-wear plate horizontal restraint. With member 62 configured to rock on surface 73 as described, the roller vertical position with respect to body plate 16 remains essentially constant throughout its range of longitudinal rolling motion. The instant the vertical loading of the roller is removed by upward displacement of wear plate 16, the longitudinal force between the end abutment and the elastomeric member 40 (into which the abutment has been thrust as a result of the described rocking motion of member 62) will urge member 62 toward its centered, upright position, thereby increasing the inclination of that portion of surface 66 on which roller 44 resides and urging roller 44 also to return to its centered position by gravity.

FIG. 3 also illustrates a further modified bearing carrier 68 having its base portion 70 formed with upward projections 72 and an intervening concavity 74 to elevate and confine abutment member 62. As noted hereinabove, the increased elevation of roller 44 permits use of a smaller diameter roller, which is beneficial in several respects as described for providing greater longitudinal rolling range for the roller 44. The base portion 70 may be formed even further upward if desired to arch over the space intermediate the fasteners 14 and to thereby elevate abutment member 62 and roller 44 to an even higher elevation. Yet another way to achieve such increased roller elevation is to provide an insert member (not shown) within housing 68 beneath the abutment member 62.

FIG. 4 discloses another alternative embodiment of the invention similar in many salient respects to that described with reference to FIGS. 1 and 2, but having an abutment member 76 with an elongated, essentially flat base portion 78 and upstanding portions 80 with the integral corner portions joining abutments 80 to base 78 being of significantly smaller radius than portions 54 of FIG. 2. In addition to a slightly concave upper surface of base portion 78, centering of the roller 44 may be provided by biasing elements 82 which are engageable with opposed lower surface portions 84 of the roller 44 and also engageable with inner surfaces 86 of abutment member 76 adjacent the lower corners thereof. Biased retainers 82 may be of solid, soft elastomer construction, and preferably are formed to leave a corner void 83 into which they may deform when contacted by roller 44.

FIG. 5 illustrates yet another embodiment of the invention in which the entire cavity within the side and end walls of a side bearing carrier or housing is occupied by an enlarged upstanding elastomeric column 88 and an asymmetrical abutment member 90 having an upwardly concave recess in which there is received a roller 44. Accordingly, abutment member 90 includes a base portion 92 and a single upstanding abutment portion 94 which extends upwardly adjacent the longitudinally inner side of elastomeric column 88 for longitudinal confinement of the same. The opposed end 96 of abutment member 90 interfaces with the end wall portions 24 of the bearing carrier thereby serving to position the abutment member 90 and provide a reaction interface to bear the longitudinal forces imposed upon abutment member 90 by confinement of elastomeric member 88 in operation. End portion 96 together with upstanding abutment 94 and connecting base portion 92 define an upwardly opening recess 98 within which roller 44 is free rolling between longitudinal limits in much the same manner as above described with reference to other embodiments. In addition, it is noted that the base portion 92 is of increased thickness thus illustrating another means for elevating roller 44 to thereby permit the use of a smaller diameter roller, with the attendant benefits as hereinabove described.

Additional embodiments and aspects of the invention are illustrated by FIGS. 6 to 15. FIG. 6 shows a side bearing similar to that shown in FIG. 5 and mounted on a truck bolster 101. FIG. 6 also includes a generally schematic representation of a car body wear plate 100 which is carried by a structural member 102 that is rigidly affixed with respect to a railway car body or platform (not shown). In FIG. 6, the side bearing roller 44 is shown residing at one extreme position with respect to spacer or abutment member 90 and spaced a near maximum longitudinal distance from a compliant bearing means shown as an elastomeric element 88.

As noted hereinabove, one favorable aspect of the embodiment of FIG. 5 is that it allows use of a minimum-length wear plate. The wear plate which engages a side bearing must always be provided with a bearing surface area and dimensions to maintain proper bearing contact with the truck side bearing throughout the entire range of relative motion between the side bearing and the wear plate. In the case of prior side bearings with elastomeric bearing elements, the length of the car body wear plate had to be sufficient to maintain full coverage contact with the entire upper surface area of both of the elastomeric elements throughout the entire range of relative movement between the car body and the truck bolster.

Prior elastomeric side bearings, when they have included a separate rigid stop such as a rocker or a roller, typically have included a pair of longitudinally spaced elastomeric bearing elements with the rigid stop disposed therebetween. As it has been essential to maintain full coverage contact of the wear plate on the elastomeric bearing element engagement surfaces, the required length of the wear plate has been considerably greater than would be otherwise desirable.

The asymmetrical bearing structure of FIGS. 5 and 6, having only a single elastomeric element and a solid stop such as the roller 44 disposed adjacent thereto, permits use of a much shorter wear plate. While the wear plate must still maintain full coverage of the upper bearing surface 104 of elastomeric element 88, there is no second elastomeric element spaced from the element 88 to impose a similar coverage or surface engagement requirement at a location spaced from elastomeric element 88. Instead, the only other requirement for bearing surface engagement is that the wear plate 100 be capable of engaging roller 44 in load bearing engagement throughout the available range of relative movement between the car body and the truck bolster 101, and throughout the available range of rolling movement for roller 44 with respect to abutment member 90.

As shown in FIG. 6, even with roller 44 at the extreme position spaced as far as possible from elastomeric element bearing element 88, the high point of the roller top 106, which is the load bearing surface of roller 44, defines the furthest extent to which the adjacent end portion 108 of wear plate 100 must reach. So long as at least the end portion 108 of wear plate 100 overlies the bearing surface 106 of roller 44, load bearing engagement may be maintained therebetween.

Thus It will be appreciated that since the load bearing surface portion of the roller does not extend throughout the longitudinal extent of the roller structure, but rather is centered with respect to it, the wear plate 100 need not extend to overlie the entire longitudinal extent of roller 44. That is, essentially half of roller 44 may lie outboard of the longitudinal reach of wear plate 100 since that portion of the roller 44 is never engaged by the wear plate 100. As a result, the required wear plate length is minimized. This feature is particularly beneficial for newer articulated cars having closely spaced car body segments, where the use of conventional side bearing designs may pose difficult car structure design problems.

Figure 8:
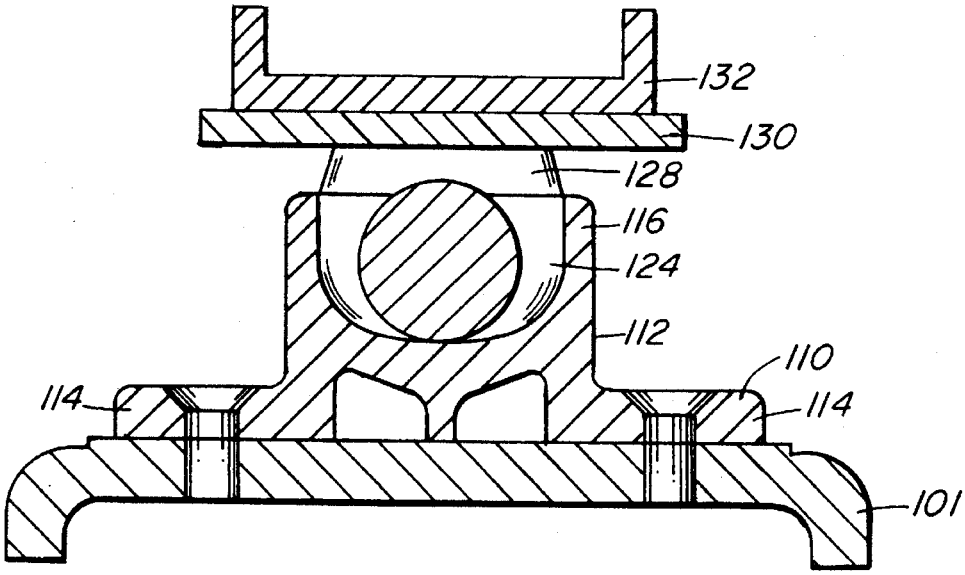
FIG. 8 is a sectioned side elevation taken on line VIII—VIII of FIG. 7.

FIGS. 7 and 8 show another embodiment of the invention which may be regarded as somewhat similar in structure to the embodiments of FIGS. 2 or 3, but with side bearing assembly 10 turned by 90° with respect to its orientation in the FIG. 2 and 3 embodiments. The free rolling rigid element, however, retains a rolling orientation generally tangent to truck rotation. More specifically, the side bearing 110 of FIGS. 7 and 8 is mounted on a truck bolster 101 and includes a carrier or cage such as a unitary cast cage member 112 with integral mounting lug portions 114 and a perimeter wall structure including end walls 116 and side walls 118. The cage 112 also includes integral interior partitions 120 spaced from each other and from side walls 118 to define three cavities 122, 124, and 126 for receiving bearing elements therein.

The intermediate cavity 124 is dimensioned in accordance with the above disclosure regarding other embodiments to receive roller 44 for free rolling of roller 44 therein between predetermined limits in the longitudinal direction, that is longitudinally with respect to a car body as above disclosed. Cavities 122 and 126 are spaced laterally to either side of cavity 124 and are dimensioned to receive and confine elastomeric bearing elements 128 for engagement with a wear plate 130 carried by a support structure 132 of a car body (not shown).

In this embodiment of the invention, the restraint characteristics provided by the elastomeric element and roller combination will be quite similar to those achieved with other embodiments of the side bearing above described; however, in the FIG. 7 and 8 embodiment, the elastomeric and rigid bearing elements are spaced apart in the lateral direction rather than in the longitudinal direction. Accordingly, this arrangement also serves to permit optimization of wear plate dimensions by reducing the longitudinal extent of the side bearing footprint, and thus the required wear plate length. As will be explained further hereinbelow, optimization of wear plate dimensions is generally desirable, but minimizing wear plate length in particular may be regarded as one of the more important optimization parameters.

Although the side bearing embodiments disclosed herein generally may be suitable for use in an orientation with the roller axis disposed radially with respect to the bolster center plate center, the embodiment of FIGS. 7 and 8 in particular is well adapted for use in such a radial configuration. Radial positioning of the side bearing affords a further opportunity to minimize the length and width of the car body wear plate.

Figure 9:
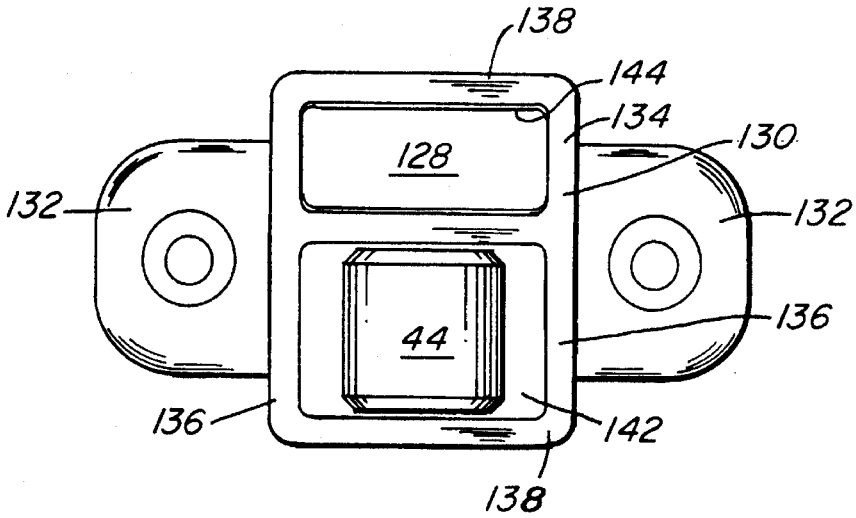
FIG. 9 is a top plan view of a further alternative embodiment of the invention.

FIG. 9 shows a modification of the FIG. 7 and 8 embodiment as an asymmetrical bearing structure similar in some respects to the FIG. 5 and 6 embodiments but with the roller turned 90° from the roller orientation shown in FIGS. 5 and 6, so that the roller rolls along side a single elastomeric bearing element rather than toward and away from it. More specifically, the FIG. 9 embodiment includes a cage or carrier 130 with mounting lugs 132 for mounting thereof on a truck bolster. A perimeter wall structure 134 includes end wall portions 136 and side wall portions 138. An intermediate partition 140 divides the interior space within the bounds of the perimeter wall structure 134 into laterally adjacent cavities 142 and 144. A roller 44 is disposed for free rolling within limits in cavity 142 in the direction longitudinally of the side bearing and laterally adjacent to an elastomeric bearing element 128 which is received and confined within cavity 144.

The FIG. 9 embodiment, like that of FIGS. 7 and 8, permits another mode of wear plate size optimization. Specifically, the side bearing of FIG. 9 permits the longitudinal extent of the wear plate to be minimized, and in addition permits its lateral extent to be reduced further over that required by the FIG. 7 and 8 embodiment. Like the FIG. 7 and 8 embodiment, the side bearing of FIG. 9 can also be oriented in a radial position with respect to the truck center plate to minimize both the length and width of the car body wear plate. Also, it may be oriented on the truck bolster with the elastomeric column either inboard or outboard of the roller element.

Figure 10:
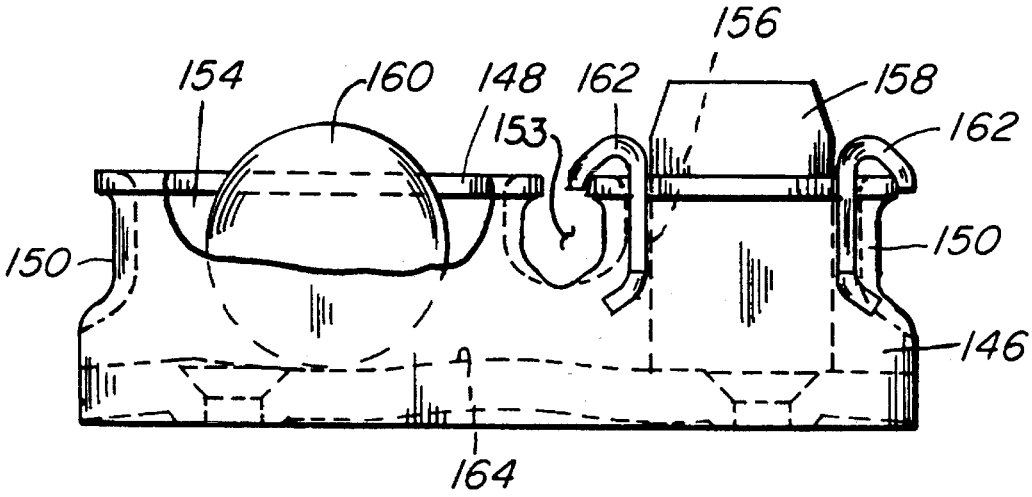
FIG. 10 is a side elevation, partially broken away, of still another alternative embodiment of the invention.
Figure 11:
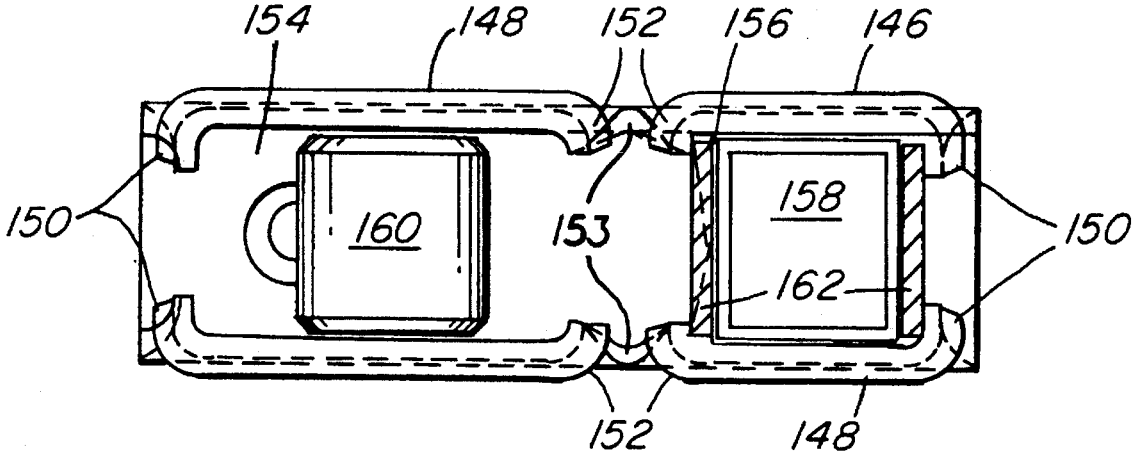
FIG. 11 is a top plan view of the embodiment of FIG. 10 with portions broken away.

FIGS. 10 and 11 disclose another asymmetrical side bearing having a single elastomeric element and a rigid stop such as a roller element disposed adjacent one another within a fabricated cage. More specifically, in FIGS. 10 and 11 a cage member 146 may be formed by forming processes similar to those employed in the fabrication of conventional side bearing cages or carriers to include upstanding lateral side walls 148 and inturned longitudinal ends 150. In addition, intermediate the longitudinal ends of the carrier, a portion of each side wall 48 may be inwardly formed or inturned at longitudinally adjacent locations to provide inturned portions 152 to divide the area within the confines of the carrier side and end walls into longitudinally adjacent cavities 154 and 156. An opening or breach 153 is thus formed, as shown, intermediate each pair of inturned portions 152. An elastomeric bearing element 158 is received in cavity 156 and a rigid bearing element such as a roller 160 is received longitudinally adjacent thereto within cavity 154 for free rolling within limits longitudinally of the carrier 156 toward and away from elastomeric bearing element 158.

As in all of the above described embodiments, elastomeric element 158 is provided with longitudinally spaced high buttresses or abutments, the buttresses in this case being in the form of conventional shim plates 162 shown in side elevation in FIG. 10 and in plan view, partially broken away, in FIG. 11. These high-reaching buttress elements confine upper portions of the elastomeric element in the longitudinal direction to maintain more uniform engagement of the bearing element with a wear plate throughout relative motion therebetween under all levels of vertical loading. Of course, as in the above described embodiments, the uppermost extent of shim plates 162 is in any event lower than the uppermost extent of roller 160 so that the wear plate never engages the shim plates 162.

The FIG. 10 and 11 embodiment also discloses structure by means of which the desirable high-reaching buttressing for the elastomeric element may be achieved while maintaining use of a larger diameter roller than is used in other above described embodiments. Specifically, the FIG. 10 and 11 embodiments do not require any saddle or carrier member for the roller 160 such as disclosed in the FIG. 2 to 5 embodiments, for example. Accordingly, the base surface 164 on which roller 160 rolls is at a lower elevation than the corresponding surface in the FIG. 2 to 5 embodiments. As a result, a larger diameter roller may be utilized.

Of course it will be appreciated that use of a larger diameter roller in a given longitudinal space envelope reduces the available rolling range for the roller. Accordingly, to maintain a desired rolling range in a side bearing of the FIG. 10 and 11 embodiment, it may be necessary to extend cage 46, depending upon the diameter of the roller to be used, in order to provide the desired rolling range. However, despite the longer cage length, the FIG. 10 embodiment will still accommodate a shorter car body wear plate than will prior side bearing designs, due to the benefit of the asymmetrical side bearing arrangement as discussed above.

It may be determined in some circumstances that the benefit of a larger roller outweighs the desirability of a long rolling range within the bearing cage. Accordingly, the option provided by the instant invention of choosing a larger or a smaller roller is another example of the way in which the invention allows optimization of the side bearing and wear plate footprint.

Figure 12:
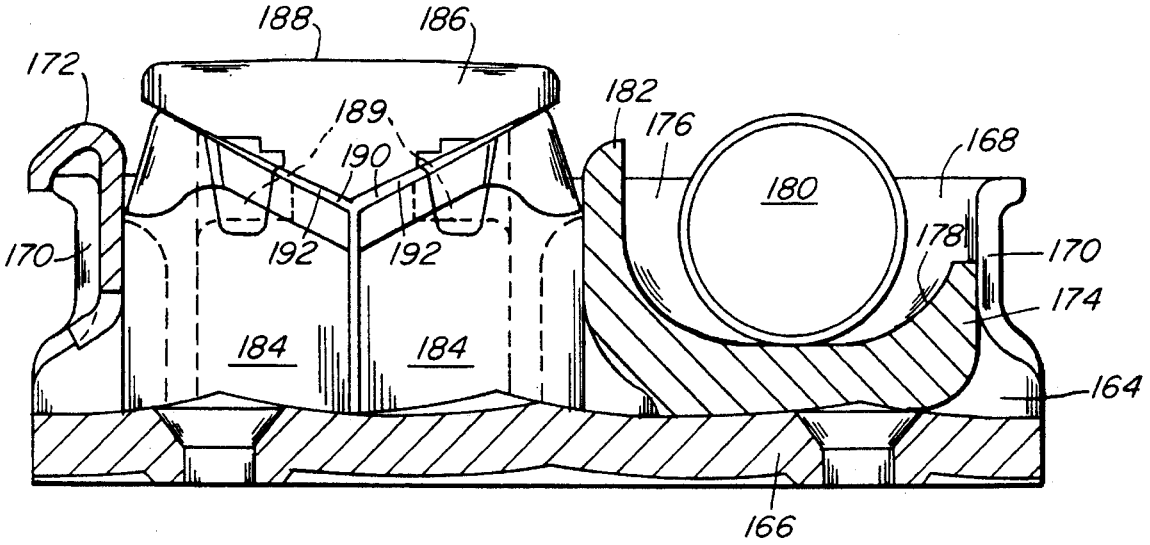
FIG. 12 is a sectioned side elevation of another alternative embodiment of the invention.

In FIG. 12 a further embodiment of the invention is disclosed as a side bearing 164 comprised of an elongated cage or carrier 166 which may be fabricated by conventional means to include upstanding, longitudinally extending side walls 168 and inturned end portions 170 which are adapted to receive shim plates 172. A saddle member 174, which may be similar to that described with reference to FIG. 5, is disposed within a cavity 176 defined within the confines of the side walls 168 and inturned ends 170 of carrier 166. Saddle 174 is located adjacent one longitudinal end of carrier 166 and includes a downwardly concave upper surface 178 on which a roller 180 is received for free rolling thereon within longitudinal limits.

A longitudinal end 182 of saddle 174 extends upwardly to form a high-reaching buttress to confine between itself and the opposed end of carrier 166 a compliant bearing means which includes a pair of longitudinally adjacent elastomeric bearing elements 184 and a rigid, unitary bearing element 186 disposed atop the elastomeric bearing elements 184 and having an upper surface 188 which is adapted to engage a car body wear plate (not shown).

The elastomeric elements 184 are confined laterally by side walls 176 and longitudinally by shim plate 172 (also referred to as an end plate) and high-reaching buttress 182. In addition, the upper surfaces 190 of elastomeric bearing elements 184 which engage corresponding lower surface portions 192 of rigid bearing element 186 preferably are inclined with respect to the horizontal so as to converge downwardly. Accordingly, vertical loads applied through a car body wear plate to rigid bearing element 186 act through the interface between surfaces 190 and 192 to urge the elastomeric bearing elements apart in longitudinally opposed directions thereby maintaining uniform location of the bearing elements 184 within carrier 166 in all modes of bearing operation. In addition, the tendency of vertical loads to urge bearing elements 184 longitudinally apart automatically takes up any slack or free motion of the elastomeric portion of the FIG. 12 side bearing assembly such as might result from progressive bearing wear or variation of component dimensions within manufacturing tolerances. The resulting confinement of the elastomeric elements 184 provides for a uniform and consistent restraint characteristic.

Other features of the FIG. 12 embodiment include interlocking tongue portions 189 of rigid element 186 which project vertically downward into cooperating recesses formed in the upper surfaces 190 of the elastomeric elements 184. Interengagement of the tongues and recesses serves not only to interlock the rigid element 186 to elastomeric elements 184, but additionally to carry laterally directed forces between the rigid element 186 and elastomeric elements 184 in part by lateral compression of the elastomeric elements 184 between the tongues 189 and the sidewalls of the bearing carrier.

Additionally, the angle of inclination for surfaces 190 may be steeper than that for surfaces 192 so that vertical compression of the elastomeric columns 184 is maintained as a uniform percentage of the overall elastomeric column height across the entire elastomeric column horizontal cross section.

Figure 13:
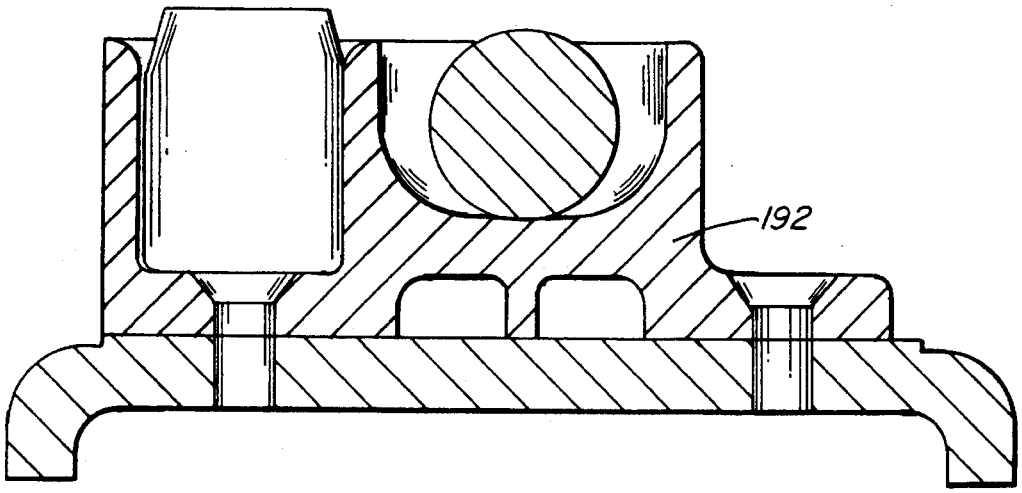
FIG. 13 is a sectioned side elevation of another alternative embodiment of the invention.

FIG. 13 shows a further example of a side bearing according to the instant invention wherein the bearing carrier or cage 192 is cast as a unitary member to include the mounting lugs or similar mounting structure, an elastomeric bearing element receiving cavity, a roller element receiving cavity, a free rolling range for the roller within the roller receiving cavity, high reaching longitudinal buttress portions to confine the elastomeric bearing element, and other structural elements corresponding to features of the embodiments above described, including an integral roller saddle portion with a high elevation floor or base to permit utilization of a smaller diameter roller.

Figure 14:
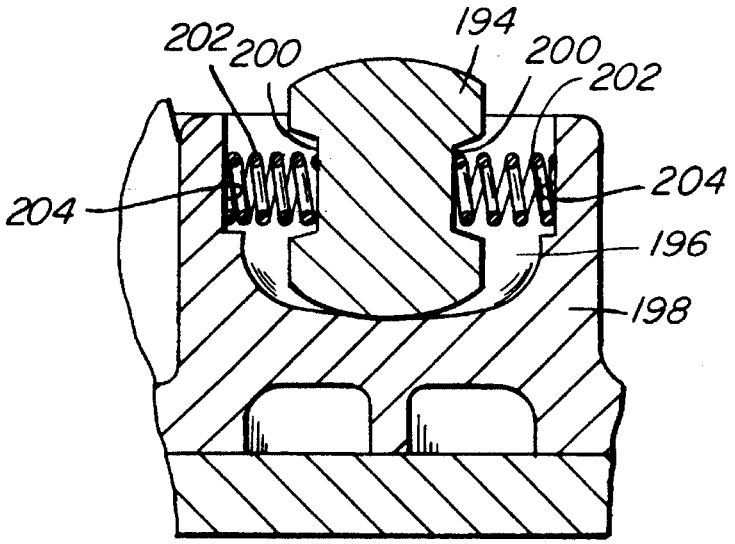
FIG. 14 is a sectioned side elevation of a fragmentary portion of a side bearing showing a further alternative embodiment of the invention.
Figure 15:
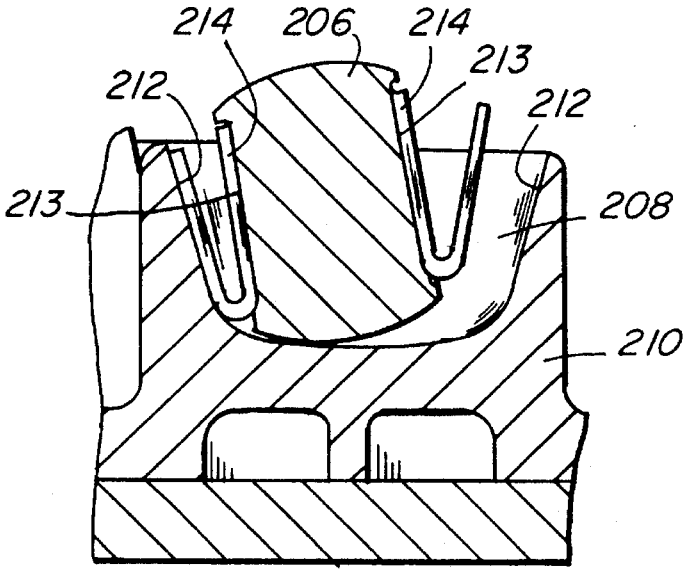
FIG. 15 is a sectioned side elevation similar to FIG. 14 showing yet another alternative embodiment of the invention.

FIGS. 14 and 15 show fragmentary portions of a side bearing similar to that shown in FIG. 13 but including a rocker element instead of a roller as a rigid or solid stop. As has been noted hereinabove, a self-centering roller, or more generally a self-centering rigid stop, is desirable as one of the numerous disclosed ways in which the side bearing structure may permit optimization of the side bearing footprint. A self-centering structure such as a rocker permits accommodation of a larger radius rolling element in a given rolling pocket length.

As above noted, it is desirable to have available a free rolling range, or more generally a range of free motion, for the solid stop bearing element in the longitudinal direction so that when the wear plate is engaged on the solid stop, relative movement of the wear plate on the side bearing will not be restricted by limits on the available range of roller or rocker movement. If the roller or rocker is free to move throughout an extended range of relative motion, the restraint characteristic of the side bearing can be more easily maintained as a uniform characteristic since rolling engagement of the wear plate with the roller or rocker element will carry all the overloads beyond the load magnitude which produces the solid bearing condition while introducing no significant increment of restraint to relative pivoting movement between the car body and the truck. Accordingly, for all overload conditions, the elastomeric bearing element or elements will be under an essentially constant maximum vertical load and the elastomer shear restraint will be consistent and uniform.

The required range of longitudinal movement for a solid bearing element can be minimized if the solid bearing element is positively self-centering. If the solid stop is positively self-centering, a shorter rolling cavity length will permit a sufficient range of movement in either longitudinal direction to accommodate the full range of longitudinal wear plate movement. Gravitational centering as disclosed in other embodiments generally will permit more free oscillating motion of the rolling element when not under load. This results in less assurance that the rolling cavity limits will permit a sufficient range of roller motion under overload conditions, since the roller position when initially engaged by the wear plate will be less predictable.

FIGS. 14 and 15 disclose two structures for dealing with this problem. In FIG. 14, a rocker 194 is disposed within a cavity 196 of a bearing carrier 198. Opposed recesses 200 on the longitudinally opposed sides of rocker 194 receive ends of respective coil springs 202. The opposed ends of the respective springs 202 are received in recesses 204 which are formed in the respective longitudinally spaced upstanding end wall portions of cavity 196. Springs 202 preferably are identical and are maintained in a state of generally equal compression (which may include essentially zero compression) with the rocker centered, so that they exert essentially equal opposing longitudinal forces which serve to positively center rocker 194 longitudinally within cavity 196. The springs are preferably to be uncompressed when the rocker is centered, as any difference in the spring rate or length will result in the rocker being maintained, when not under load, in an off-center position. FIG. 15 shows one spring bias centering arrangement which exerts essentially zero spring bias on the rocker at the centered position.

In FIG. 15 a solid stop structure is shown in which a rocker 206 is received within a cavity 208 formed in a carrier 210 having longitudinally opposed end walls 212 which diverge upwardly and are spaced apart sufficiently to provide a range of free motion for rocker 206 therebetween. Spring elements 214 are affixed adjacent the opposed longitudinal sides of rocker 206. Springs 214 are generally of a V-shape having one leg of the V affixed to a longitudinal side 213 of rocker 206 and the opposed leg of the V being free to engage a respective cavity surface 212.

On movement of the rocker 206 in rocking motion longitudinally of cavity 208, the free leg of one or the other of springs 214 engages the respective cavity wall 212 and is compressed toward the other leg of the same spring to thereby bias rocker 206 back toward a centered position. Springs 214 thus function in a manner similar to springs 202 of FIG. 14 to maintain the rocker 206 in a centered position.

Positive self-centering is not the only benefit of the spring bias arrangements shown in FIGS. 14 and 15. In these figures, the rocker elements 194 and 206 are shown in bearing cages with elevated rocker bases. That is, they are shown in configurations which are described above as being intended for smaller diameter rollers or rockers. However, when used in an embodiment without an elevated rocker floor, the positive self-centering structure can be much more important.

Without the elevated rocker floor, a larger diameter rocker may be used, and indeed in many circumstances a larger diameter rocker may be desirable, for example a 4" diameter rocker. As has been noted, however, a larger diameter solid bearing element requiring a given minimum longitudinal range of free movement will require a corresponding longitudinal clearance within the bearing cage. A larger diameter roller thus requires a larger longitudinal clearance. The use of a rocker, which is essentially a roller with its upper and lower radiused portions intact and its sides truncated, reduces the longitudinal clearance requirement and thus helps to optimize side bearing overall size by minimizing the overall side bearing length requirement even though the radiused surfaces of the rocker present a relatively large diameter structure for rolling engagement with the bearing in the solid condition.

The positive centering structures disclosed in FIGS. 14 and 15 serve to permit the further reduction of the longitudinal clearance required by the rocker since, as noted hereinabove, a self-centering structure helps to ensure that the rocker element will be centered when first engaged by the wear plate as the bearing goes solid. Accordingly, use of a rocker with positive centering within a space offering a range of free longitudinal movement permits overall bearing length to be minimized in general without resorting to a smaller diameter solid stop bearing element for rolling engagement with the wear plate in the solid condition. Of course, the FIG. 14 and 15 embodiments relate to the use of a rocker in lieu of a roller in a much more general sense. If a range of longitudinal freedom is provided for a rocker, the rocker design will be limited by the requirement that the rocker be stabile, i.e. self-righting when displaced from its upright position. The disclosed springs may permit use of a rocker design, for example a rocker of minimal longitudinal extent, which is not inherently self-righting.

Described hereinabove are a number of structural advances in side bearings which permit the overall dimensions of the side bearing, most notably its longitudinal extent (in the direction of the car body length), to be minimized. One motive for achieving such minimal dimensions is seen in the design and geometry of such railway rolling stock as long intermodal cars wherein a shorter overall side bearing structure and shorter bearing footprint are highly desirable due to the more restrictive bearing space limitations. For example, the increased distance between the trucks of long intermodal cars results in a larger maximum angle between the connected cars in turns. This can result in the adjacent side bearing wear plates of the pivoted car bodies on the inside of the turn coming into closer than usual proximity to each other.

All of the above described asymmetrical bearing structures wherein a rigid or solid stop is located adjacent to a single elastomeric bearing element or a compliant bearing assembly can be of significant benefit for reasons beyond the desirability of optimizing the bearing footprint or the wear plate surface dimensions. For example, such an asymmetrical bearing structure allows freedom in the process of selecting of the maximum load bearing location with respect to the bolster and the car body.

As has been noted, all bearing loads beyond those required to bring the bearing to a solid state or condition are carried by the bearing rocker or roller. Accordingly, by merely turning the asymmetrical side bearing assembly end-for-end, the location of the elastomeric bearing element with respect to the location of the bearing overloads may be changed. In some embodiments of the invention, this may be accomplished by simply removing the solid stop, saddle member, and elastomeric column from the bearing cage and reversing their positions therein. In other embodiments, the entire side bearing is turned end-for-end. The invention thus provides a side bearing which is adapted for use in a variety of configurations to achieve distinctly different objectives.

More specifically, in some rolling stock such as modern high load capacity cars, the invention permits side bearings to be placed closer to the truck bolster center line. Side bearings located as close as possible to the bolster center line are less able to exert a turning moment on the bolster tending to rotate it about its longitudinal axis. For those instances in which it is deemed most desirable to avoid such turning moments, an asymmetrical side bearing structure of the present invention may be so mounted that the solid stop is located longitudinally closer to the bolster center line and the elastomeric element is located longitudinally further therefrom. This orientation will produce the smallest possible turning moments upon the bolster as all overloads tending to overturn the bolster will be acting on the shortest possible moment arm.

There may be other circumstances in which it is more desirable to locate the solid stop as close as possible to the car body support structure. For example, in such rolling stock as long intermodal cars the side bearing wear plates of the car bodies may often be supported on outrigger structures which extend laterally and/or longitudinally from the car body frame to a position overlying the side bearing carried by the truck bolster. The required strength of such wear plate support structures is determined in part by the distance of the maximum loads borne by the wear plate from the car body frame.

An incremental strength requirement due to a larger distance between the car body frame and the furthest point of maximum wear plate load application will necessitate a more massive wear plate support structure, including enlarged beam sections and gussets over those which would be required if the maximum wear plate loads were borne closer to the car body frame.

Since the maximum loads borne by the wear plate occur where the wear plate engages the solid stop of the side bearing, an orientation with the side bearing solid stop located closer to the car body frame and further from the bolster center line may be desirable in such instances. Of course, in general it is always desirable to minimize the structural mass of any portion of a railway car, including the side bearing wear plate support structure, in order to minimize the car tare weight.

The above described side bearing structural features can be utilized in various combinations to selectively position or locate the application of overload forces, provide for free rolling wear plate to bearing engagement throughout the range of overload forces borne by the bearing after the wear plate goes solid upon it, maintain uniform elastomeric bearing restraint (especially shear restraint) throughout the range of overload forces borne on the side bearing and reduce side bearing footprint size.

According to the description hereinabove there is provided by the instant invention a novel and improved side bearing assembly for use especially in conjunction with modern rail car body and truck configurations. Although the invention has been described with reference to certain presently preferred embodiments, it will be appreciated that I have envisioned various alternative and modified embodiments within the scope of the invention as described. Among such modifications, I have contemplated a side bearing generally as above described but with more than two elastomeric columns spaced longitudinally of a bearing carrier and with rollers free rolling within limits in between abutment members disposed between each pair of adjacent elastomeric columns. Additionally, a bearing of this invention may be constructed to the proportions of an unusually elongated housing member to provide a single bearing assembly which provides support for both of the mutually adjacent ends of a pair of car platforms which are supported on a common truck bolster. The elastomeric columns may be configured in a variety of geometric shapes and from a variety of elastomeric materials according to the performance requirements of the particular car body and truck assembly. Certainly such alternative embodiments would also occur to others versed in the art, once apprised of my invention. Accordingly, it is intended that the invention be construed broadly and limited only by the scope of the claims appended hereto.

I claim:

1. A railway vehicle side bearing adapted to be carried by a railway truck for engagement with a car body wear plate in load bearing engagement comprising:

a rigid housing;

said housing including an elongated base portion and a pair of opposed, spaced apart upstanding wall portions extending vertically upward of said base portion and having respective uppermost edges;

an upwardly open cavity defined within said housing intermediate said pair of wall portions, respectively;

upwardly facing surface means extending within said cavity;

rigid bearing means supported on said upwardly facing surface means for movement thereon within predetermined limits in a given direction;

compliant bearing means disposed within said cavity at a location spaced from said upwardly facing surface means in a direction transverse to said given direction;

said compliant bearing means having a respective upper end surface means disposed vertically above said uppermost edges and including at least one upstanding, resiliently deformable elastomeric bearing element;

said rigid bearing means being of an overall vertical height, when supported on said upwardly facing surface means, that said rigid bearing means has an uppermost extent located above said uppermost edges of said pair of wall portions;

upstanding abutment means disposed within said cavity intermediate said compliant bearing means and said rigid bearing means and extending upwardly adjacent said elastomeric bearing element to an elevation intermediate the elevation of said uppermost extent of said rigid bearing means and said uppermost edges of said wall portions to at least partially confine said compliant bearing means; and said elastomeric bearing element being vertically deformable in compression and having an overall vertical height when supported within said cavity that said upper end surface means of said compliant bearing means is disposed at an elevation vertically above said uppermost extend of said rigid bearing means to maintain a vertical spacing between said rigid bearing means and such car body wear plate throughout a range of vertically downwardly directed loadings applied to said elastomeric bearing element by engagement of said compliant bearing means with such car body wear plate, and to permit such car body wear to engage said rigid bearing means when said vertically downwardly directed loadings on said elastomeric bearing element equal a given load.

2. The side bearing as set forth in claim 1 wherein said compliant bearing means includes a pair of spaced apart, compliant bearings disposed within said cavity with said upwardly facing surface means disposed intermediate said pair of compliant bearings.

3. A railway vehicle side bearing adapted to be carried by a railway truck for relative shearing movement with respect to a car body wear plate while in load bearing engagement with such wear plate, said side bearing comprising:

a rigid housing;

said housing including an elongated base portion and upstanding wall portions extending vertically upwardly of said base portion and having respective uppermost edges;

an upwardly open cavity defined within the confines of said wall portions;

upwardly facing surface means extending within said cavity;

rigid bearing means disposed on said upwardly facing surfacing means for movement thereon within predetermined limits in a given direction generally in alignment with the direction of such relative shearing movement between said side bearing and such wear plate;

a single compliant bearing means disposed within said cavity at a location spaced from said surface means in a direction transverse to said given direction;

said compliant bearing means having an upper end surface means disposed vertically above said uppermost edges for load bearing engagement with such wear plate;

said compliant bearing means including at least one upstanding, resiliently deformable elastomeric bearing element;

said rigid bearing means being of an overall vertical height, when disposed on said upwardly facing surfacing means, that said rigid bearing means has an uppermost extent located above said uppermost edges of said wall portions for load bearing engagement with such wear plate;

upstanding abutment means disposed within said cavity intermediate said compliant bearing means and said rigid bearing means, and extending upwardly adjacent said compliant bearing means to an elevation above the elevation of said uppermost edges of said wall portions; and said elastomeric bearing element being vertically deformable in compression and having an overall vertical height when disposed within said cavity that said upper end surface means of said compliant bearing means is disposed vertically above said uppermost extend of said rigid bearing means to maintain a vertical spacing between said rigid bearing means and such car body wear plate throughout a range of vertically downwardly directed loadings applied to said elastomeric bearing element by engagement of said compliant bearing means with such car body wear plate, and to permit such car body wear plate to engage said rigid bearing means when said vertically downwardly directed loadings on said elastomeric bearing element equal a given load.

* * * * *